US005799425A

United States Patent [19]

Merser et al.

[11] Patent Number: 5,799,425

[45] Date of Patent: *Sep. 1, 1998

[54] CLOTHING TAG

[75] Inventors: F. Gerard Merser, Round Pond, Me.; Richard J. Madigan, Jr., Mansfield, Mass.

[73] Assignee: Avery Dennison Corporation, Pasadena, Calif.

[ * ] Notice: The term of this patent shall not extend beyond the expiration date of Pat. No. 5,373,656.

[21] Appl. No.: 391,681

[22] Filed: Feb. 21, 1995

[51] Int. Cl.[6] ..... G09F 3/08

[52] U.S. Cl. ..... 40/299; 40/664; 206/807

[58] Field of Search ..... 40/664, 299, 662, 40/669, 300, 301; 206/807, 806

[56] References Cited

U.S. PATENT DOCUMENTS 5,016,369 5/1991 Parry ..... 40/301

5,373,656 12/1994 Merser ..... 40/633

FOREIGN PATENT DOCUMENTS 2042481 10/1971 Germany ..... 40/301

*Primary Examiner*—Cassandra Davis

*Attorney, Agent, or Firm*—Kriegsman & Kriegsman

[57] ABSTRACT

A tag adapted to be attached to an article of clothing or the like with a fastener of the type comprising an elongated plastic member having a cross-bar at one end. In one embodiment, the tag comprises a continuous sheet of plastic material heat sealed to a backing sheet in a blister pack type configuration so as to define a pocket into which the cross-bar may be inserted, the pocket having a sidewall which includes a guide notch. The tag is attached to an article of clothing by inserting the cross-bar of the fastener first through the article of clothing and then through the plastic sheet into the pocket, using the needle on a tagger gun to penetrate the article of clothing and also to penetrate the plastic sheet and using the notch on the plastic sheet to assist in positioning the needle of the tagger gun.

8 Claims, 3 Drawing Sheets

CLOTHING TAG

BACKGROUND OF THE INVENTION

The present invention relates generally to tags and more particularly to a novel clothing tag.

The practice of attaching tags to articles of clothing and the like by means of plastic fasteners is well known. One such type of fastener comprises a filament having a cross-bar at one end and a paddle at the other end. Such tags typically comprise a generally-rectangular sheet of tagstock or tagboard provided with a hole, the tag typically being attached to the article of clothing by inserting the cross-bar end of the plastic fastener first through the hole in the tag and then through the article of clothing using a device commonly referred to as a tagger gun. As is known, a tagger gun generally includes a hollow needle through which the fastener is dispensed and a mechanism for pushing the fastener out through the hollow needle. With the cross-bar end of the fastener thus attached to the article, the paddle end of the fastener serves to keep the tag from being pulled off the filament portion of the fastener. Information relating to the name of the manufacturer, the name of the retailer, the price of the article, or the like is typically printed on the tag. Another type of fastener often used to attach a tag to an article of clothing comprises a filament having a cross-bar at each end. Examples of tagger guns may be found in U.S. Pat. No. 3,103,666 to A. R. Bone and U.S. Pat. No. 5,024,365 to D. L. Borque, which patents are incorporated herein by reference.

One problem that has arisen with the use of such tags, particularly in connection with the sale of articles of clothing, is that certain unscrupulous consumers have made a practice of purchasing an expensive or unusual article of clothing, removing those tags attached to the garment (the tags often being conspicuously placed on the article), wearing the article of clothing once or twice, and then returning the article of clothing to the retailer for a refund. Because of the administrative difficulties associated with determining which consumers have legitimate reasons for returning their articles of clothing and which consumers are looking for refunds for worn articles of clothing, many retailers are effectively forced to issue refunds to all those who request such. As can readily be appreciated, this can result in considerable losses for the retailer as many of the worn and returned articles of clothing are no longer in new condition and cannot be re-sold for their original prices.

One approach that has been taken by some retailers to discourage consumers from wearing and then returning articles of clothing as described above has been to attach an additional tag to the article of clothing in the same manner as described above, the tag containing a warning to the consumer that removal thereof precludes the possibility of a refund for the article. Such tags are typically placed on the article of clothing in a conspicuous location so that the consumer will not want to wear the article without removing the tag. This approach, however, has not been entirely satisfactory since some consumers have discovered how to remove the fastener attaching the tag to the article of clothing in such a way as to enable the fastener and tag to be manually re-attached to article of clothing by the consumer at a later date without clearly evidencing signs of removal and re-attachment. Typically, such removal of the fastener from the article is accomplished by positioning the cross-bar so that it is parallel to the filament (i.e., by pulling on the cross-bar to create some slack in the filament and then bending the end of the filament adjacent to the cross-bar so that the cross-bar is aligned with the remainder of the filament) and then by pushing the cross-bar and the filament back through the same opening in the article of clothing through which they were originally inserted. Re-attachment of the fastener and tag to the article of clothing may then be accomplished as described above by re-inserting the cross-bar end of the fastener through the article of clothing.

In U.S. Pat. No. 5,373,656 to F. Gerard Merser there is disclosed a tag adapted to be attached to an article of clothing or the like with a fastener of the type comprising an elongated plastic member having a cross-bar at one end. In one embodiment, the tag comprises a sheet of material folded and sealed to define a pocket, the pocket being provided with an opening through which a cross-bar may be inserted. Both the pocket and the opening are appropriately sized and shaped so that, when a cross-bar of a fastener is inserted into the pocket through the opening, the cross-bar cannot easily be removed from the pocket without tampering with the pocket in a readily identifiable manner. The tag may be attached to an article of clothing in such a way as to make removal of the tag from the article of clothing and subsequent re-attachment of the tag to the article of clothing difficult to accomplish without providing evidence of tampering by inserting the cross-bar of a fastener comprising an elongated plastic member having a cross-bar at one end and a paddle at the opposite end first through the article of clothing and then into the pocket of the tag through the opening. In a second embodiment, the pocket of the tag is provided with a pair of openings so that the tag may be used with a fastener of the type comprising an elongated V-shaped plastic member having a first cross-bar at one end and a second cross-bar at a second end.

SUMMARY OF THE INVENTION

It is an object of the present invention to provide a novel clothing tag.

Accordingly, a clothing tag which may be used with a fastener of the type comprising an elongated filament having a cross-bar at one end comprises a backing sheet and a continuous sheet of plastic, the sheet of plastic being shaped and heat sealed to the backing sheet in a blister pack type configuration so as to define a pocket into which the cross-bar of the fastener may be inserted and wherein once inserted cannot easily be removed without tampering with the tag in a readily identifiable manner.

As used herein, the term "continuous sheet" means a sheet of material without any holes or slots or other types of openings.

In attaching the tag to an article of clothing, the cross-bar of the fastener is first inserted through the article of clothing and is then inserted into the pocket of the tag, using a tagger gun to puncture the plastic sheet and push the cross-bar through the plastic sheet into the pocket of the tag and also to push the cross-bar through the article of clothing. The paddle end of the fastener is not insertable through the article of clothing and thus prevents the fastener from being pulled completely through the article of clothing.

The tag may also be used with a fastener of the type comprising an elongated V-shaped member having a first cross-bar at a first end and a second cross-bar at a second end. The pair of cross-bars of the fastener may be inserted directly through the article of clothing and then inserted into the pocket using a tagger gun; alternatively, to avoid creating a pair of holes in the article of clothing as a result of inserting the pair of cross-bars of the fastener directly through the article of clothing, one of the cross-bars of the fastener may be inserted, for example, through the loop defined by a belt loop or through a button-hole or the like and then inserted into the pocket, with the other cross-bar being drawn around the article of clothing and then inserted into the pocket.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

Figure 1:
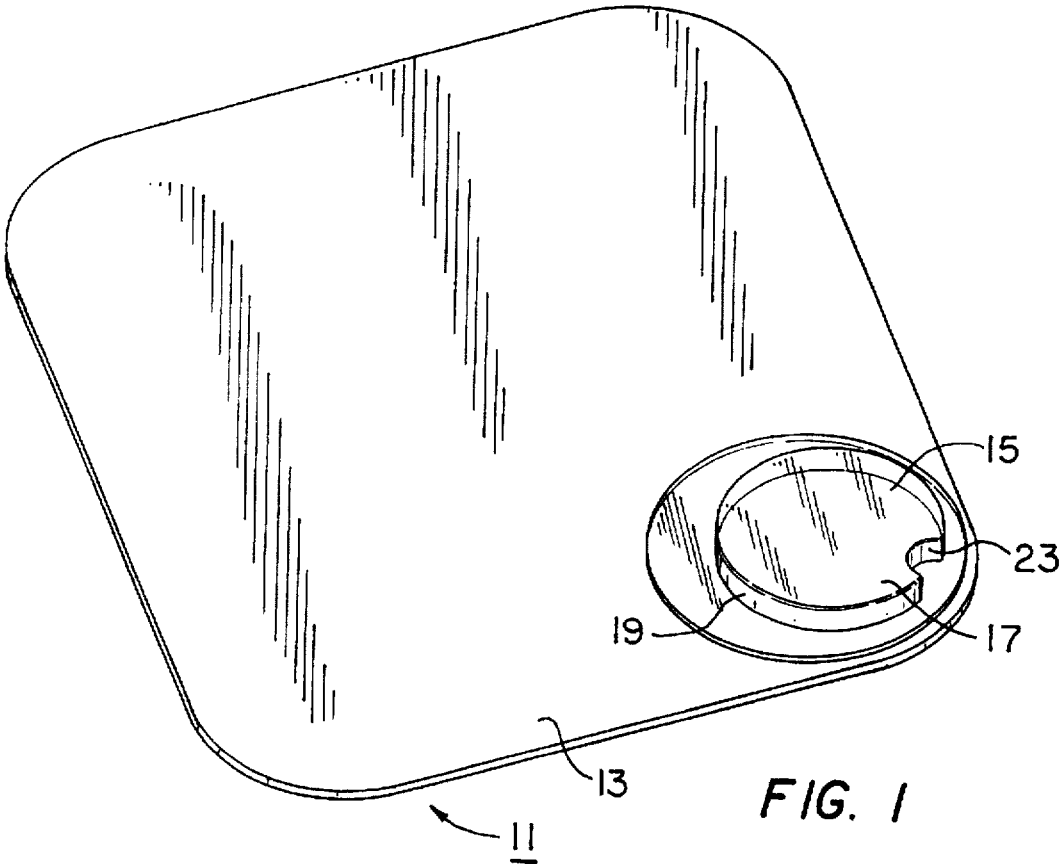
FIG. 1 is a top perspective view of one embodiment of a clothing tag constructed according to the teachings of the present invention.
Figure 3:
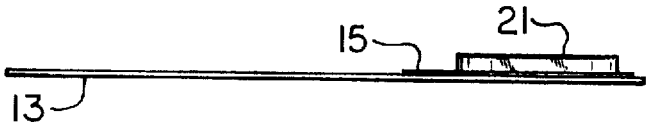
FIG. 3 is a side elevation view of the clothing tag shown in FIG. 1.
Figure 2:
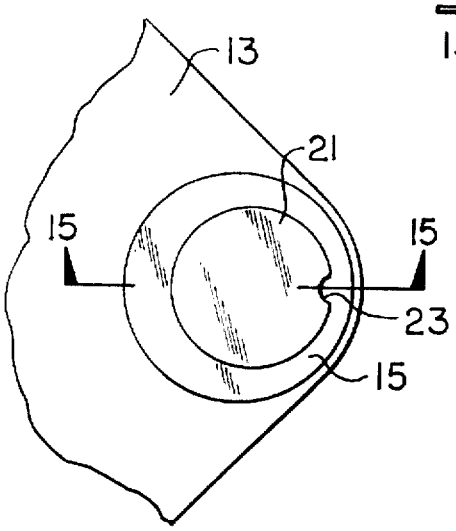
FIG. 2 is a fragmentary plan view of the clothing tag shown in FIG. 1.
Figure 4:
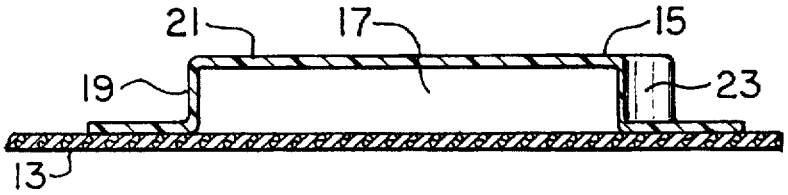
FIG. 4 is a side section view taken along lines 4—4 in FIG. 2.

Referring now to the drawings and first to FIGS. 1 through 4, there is shown one embodiment of a clothing tag constructed according to the teachings of the present invention, the clothing tag being represented generally by reference numeral 11.

Clothing tag 11 has a blister-pack type construction and comprises a backing sheet 13, such as 22 mil coated heat sealable card stock and a continuous sheet of transparent heat-sealable plastic 15, such as 15 mil (starting thickness) PVC blister stock. Plastic sheet 15 is heat-sealed to backing sheet 13 and shaped so as to form a pocket 17 having a sidewall 19 and a top 21. Sidewall 19 is shaped to include a notch 23 which may be used as a needle guide as will hereinafter be explained.

Tag 11 may be labelled with a warning to consumers that removal thereof from the article to which it is attached precludes return of the article and/or may be labelled with other pertinent retail information.

To attach tag 11 to a fastener having a cross-bar at one end, one merely has to push the cross-bar of the fastener through plastic sheet 15 into pocket 17. This may be achieved with a tagger gun (not shown) using the needle of the tagger gun to penetrate sidewall 19 of pocket 17 and notch 23 to position the needle. As can readily be appreciated, because of the construction of tag 11, once a cross-bar of a fastener has been inserted thereunto, it cannot easily be removed therefrom without tampering with tag 11 in a readily identifiable manner.

Figure 5:
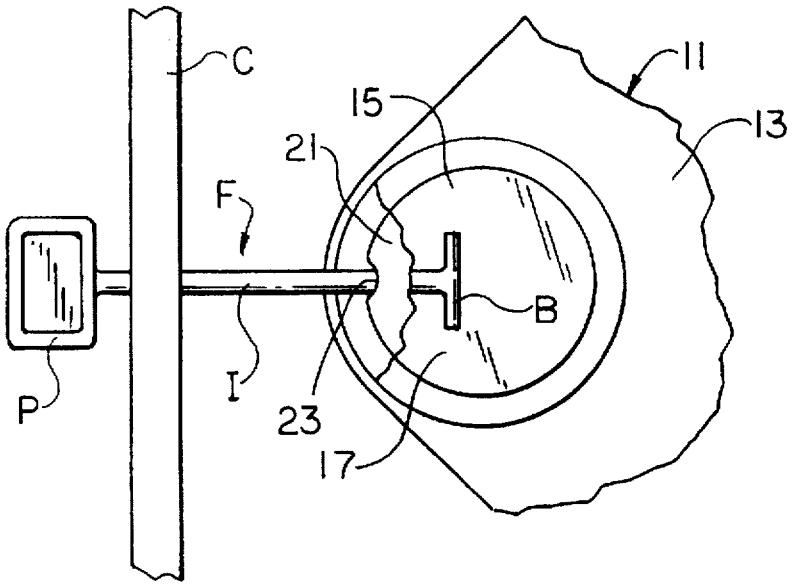
FIG. 5 is a fragmentary top view, broken away in part, illustrating how the clothing tag of FIG. 1 may be attached to an article of clothing using one type of fastener.

Referring now to FIG. 5, there is shown an arrangement wherein tag 11 is attached to an article of clothing C in such a way that it cannot easily be removed from clothing C and subsequently re-attached thereto without providing some evidence of tampering. As can be seen, this arrangement involves using a plastic fastener F of the type comprising a filament l having a cross-bar B at one end and a paddle P at the opposite end. To attach tag 11 to clothing C in the manner shown, cross-bar B is first inserted through clothing C and then through sheet 15 into pocket 17 using a tagger gun to penetrate article of clothing C and plastic sheet 15.

Figure 6:
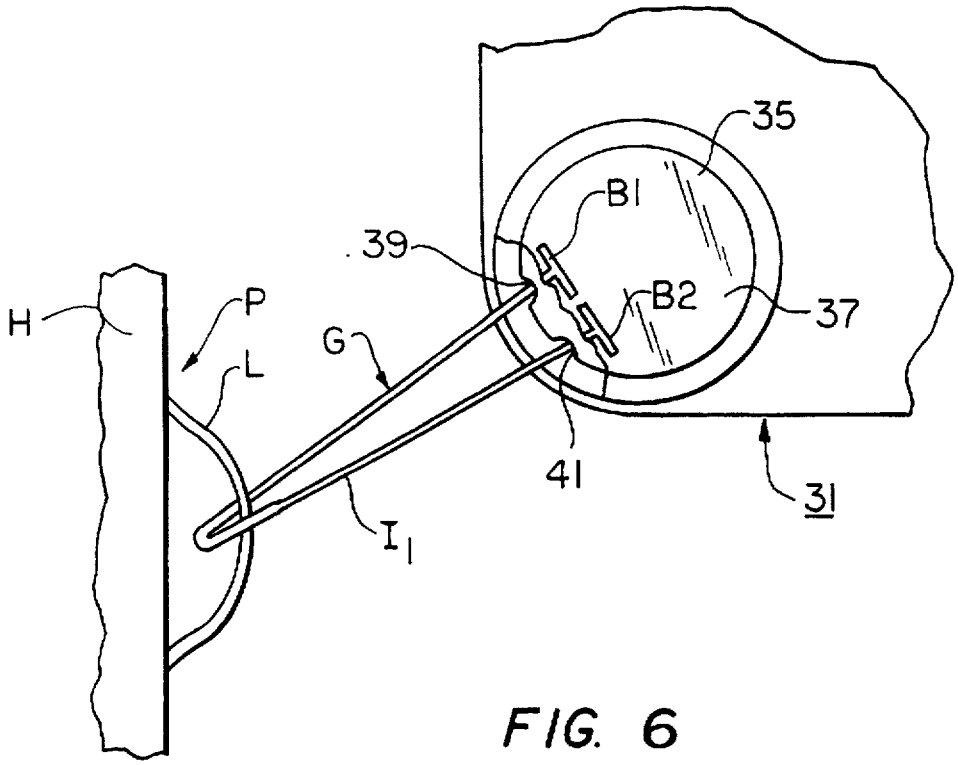
FIG. 6 is a fragmentary top view, broken away in part, of another embodiment of the clothing tag of this invention, illustrating how it may be attached to an article of clothing using another type of fastener.
Figure 7:
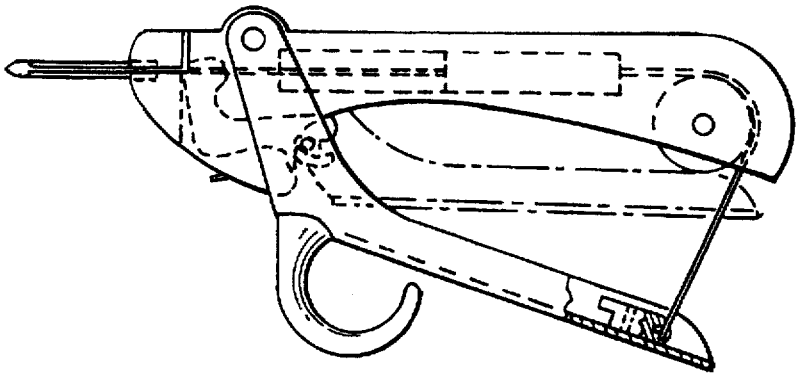
FIG. 7 PRIOR ART
FIG. 7 is a conventional tagger gun.

Referring now to FIG. 6, there is shown a second embodiment of a clothing tag constructed according to the teachings of the present invention, the clothing tag being represented generally by reference numeral 31. Also shown in FIG. 6 is a fastener G with which tag 31 may be used and an article of clothing P having a belt loop L and a main portion H. Fastener G includes a filament 11 having a cross bar $B_1$ at one end and a cross-bar $B_2$ at the other end.

As can be seen, tag 31 is very similar in construction to tag 11 in that it includes a backing sheet 33 and a continuous plastic sheet 35 heat sealed to backing sheet to define a pocket 37, the difference being that tag 31 has a pair of guide notches 39 and 41 on the sheet 35 for use with fastener G rather than a single notch as in the case with tag 11. Tag 31 may be attached to an article of clothing P by insertion of one cross-bar $B_1$ through belt-loop L (or through a button-hole or the like) and then into pocket 37 and then the other cross-bar $B_2$ using a tagger gun (not shown). As can readily be appreciated, the latter arrangement avoids creating any new holes in the article of clothing.

It should be understood that, while the tag of the present invention has been described above as being adapted for attachment to articles of clothing, the present tag is not limited to attachment to articles of clothing and may be used with any similar article of commerce.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A clothing tag for use with a plastic fastener, the plastic fastener comprising a filament member having a cross-bar at one end and adapted to be dispensed through a fastener gun, the clothing tag comprising:

a. a backing sheet, and b. a continuous sheet of plastic material heat sealed to said backing sheet and shaped to define along with said backing sheet a pocket into which said cross-bar may be inserted, said continuous sheet of plastic material including a sidewall and a first guide notch to assist in positioning said fastener gun in place for dispensing said fastener into said pocket said first guide notch being in said sidewall.

2. The clothing tag as claimed in claim 1 wherein said sheet of plastic material includes a second guide notch.

3. The tag as claimed in claim 1 wherein said backing sheet comprises card stock.

4. The tag as claimed in claim 3 wherein said sheet of plastic material is PVC blister stock.

5. The tag as claimed in claim 4 wherein said sheet of plastic material is a transparent material.

6. The clothing tag of claim 3 wherein said card stock is coated heat sealable card stock.

7. A clothing tag kit comprising a clothing tag and a fastener, said fastener comprising an elongated member made of plastic and having a filament and a cross-bar at one end of the filament, said clothing tag comprising a backing sheet and a continuous sheet of plastic material, said continuous sheet of plastic material being heat sealed to said backing sheet and being shaped to define along with said backing sheet a pocket into which said cross-bar may be inserted, said continuous sheet of plastic material including a sidewall and a first guide notch to assist in dispensing said fastener into said pocket, said first guide notch being in said sidewall.

8. A method of attaching a plastic fastener to a clothing tag, the plastic fastener having a cross-bar at one end, the clothing tag comprising a backing sheet and a continuous sheet of plastic material heat sealed to said backing sheet and shaped to define along with said backing sheet a pocket into which said cross-bar may be inserted, said continuous sheet of plastic material including a sidewall and a first guide notch to assist in dispensing the plastic fastener into the pocket, said first guide notch being in said sidewall, the method comprising:

a. providing a tagger gun having a hollow needle through which the plastic fastener may be dispensed, b. pushing at least a portion of the hollow needle through said first guide notch in the sheet of plastic material into the pocket, and c. dispensing the cross-bar end of the fastener into the pocket through the hollow needle.

* * * * *